United States Patent [19]

Stengel

[11] Patent Number: 5,037,229

[45] Date of Patent: Aug. 6, 1991

[54] CLOSURE FOR WIRE LOOP BINDER

[75] Inventor: Philip B. Stengel, Cambridge, Minn.

[73] Assignee: Creative Binding Systems, Inc., Cambridge, Minn.

[21] Appl. No.: 468,120

[22] Filed: Jan. 22, 1990

[51] Int. Cl.[5] ..... B42F 3/04; B42F 3/06

[52] U.S. Cl. ..... 402/20; 402/21; 402/60

[58] Field of Search ..... 402/19, 20, 21, 60, 402/64, 68

[56] References Cited

U.S. PATENT DOCUMENTS

| | | | |
|---|---|---|---|
| 2,123,846 | 7/1938 | Cruzan | 402/60 |
| 2,139,480 | 12/1938 | Young | 402/21 |
| 2,463,946 | 3/1949 | Brook | 402/60 |
| 4,374,627 | 2/1983 | Friedman | 402/21 |
| 4,773,787 | 9/1968 | Chang | 402/60 |

FOREIGN PATENT DOCUMENTS

| | | | |
|---|---|---|---|
| 288445 | 5/1953 | Switzerland | 402/21 |

*Primary Examiner*—Paul A. Bell

*Attorney, Agent, or Firm*—John W. Adams

[57] ABSTRACT

This is a closure unit for wire loop binder which includes a flexible outer retaining flange specifically constructed to increase the resistance to longitudinal movement between the closure unit and wire loop binder. The increased friction resists movement of the closure when assembled in the closure position.

10 Claims, 1 Drawing Sheet

FIG.1
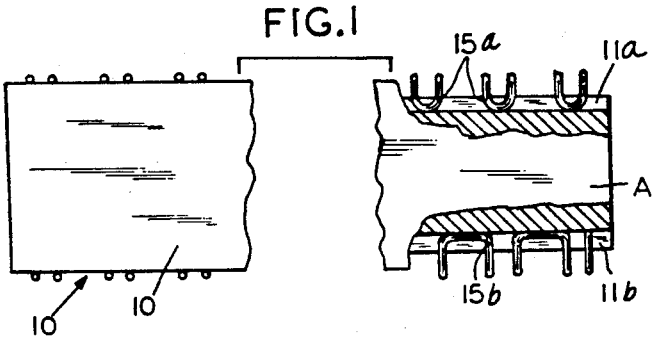
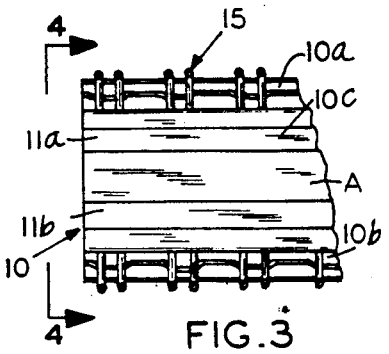
FIG.3
FIG.2
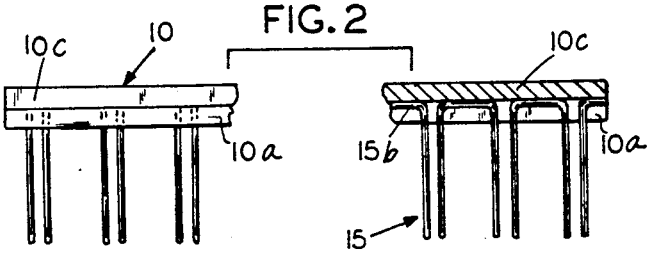
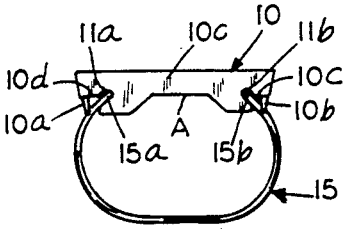
FIG.4
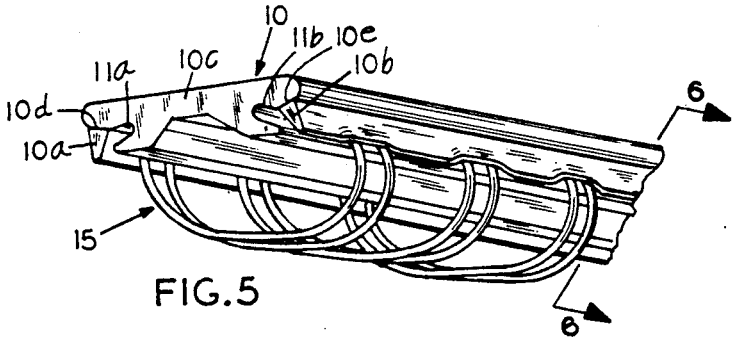
FIG.5
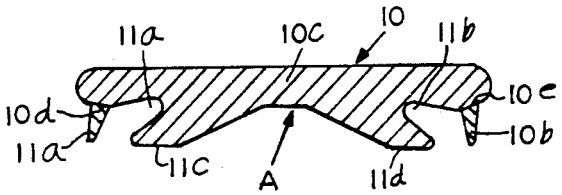
FIG.6
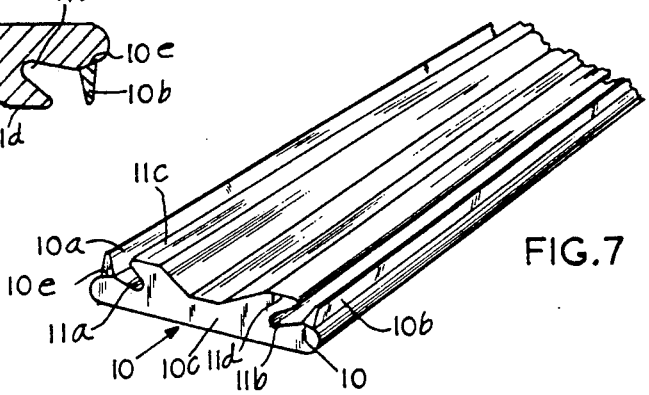
FIG.7

CLOSURE FOR WIRE LOOP BINDER

BACKGROUND OF THE INVENTION

There are a variety of binding systems available on the market today. Among them are continuous spiral binders, wire loop binders, continuous wire loop binders and resilient plastic binders.

The resilient plastic binders presently in use include a specific construction identified by the term "plastic comb" which employs a mechanical spreading device for retracting the curved fingers away from a back connecting bar to permit insertion of the fingers through the pre-punched sheets and then releasing the spreading device to close the back connecting bar around the fingers and capture the sheets on the fingers. Except for conventional split ring loose leaf binders, most of the present systems are constructed to permit only assembly of the paper sheets on the binding apparatus with the aid of a separate mechanical holding and/or spreading mechanism. This does not permit the sheets to be readily removed or additional sheets to be added to the bound booklet, without using such a mechanism.

The inventor has previously disclosed (Ser. No. 07/290,563, BOOKLET BINDER SYSTEM) a continuous wire loop binding unit which consists of the conventional continuous wire or plastic loop unit and an elongated closure unit removably inserted between the two rows of loops. The closure unit of applicant's prior unit includes a pair of spaced apart grooves respectively receiving the two rows of loops to interlock therewith. In one form of the prior unit a locking strip overlies a pair of hinged closure elements to hold the elements interlocked in closure position between the rows of loops.

Also disclosed in the prior application was another form of the invention which includes a unitary rigid closure unit with the wire loop fitting into the grooves of the closure unit. The rigid closure unit slides over the ends of the tines to form the binding unit. This unit has no effective means for maintaining it in closure position.

SUMMARY OF THE INVENTION

The present invention relates particularly to a continuous wire loop binding unit. A conventional metal wire loop construction is combined with a single integral closure unit. The single integral closure unit has a pair of spaced apart tine and loop receiving grooves whereby the outer edges of each of the respective grooves consists of a soft resilient flange made of a suitable rubber or plastic material. The retaining flange deforms when engaged by the rows of tine and loop segments. The deformation of the retaining flanges produces an increase in friction between the flange and the tine and loop segments thereby retaining the closure unit in closure position by creating resistance to unintentional movement induced by regular handling of the assembly.

This assembly differs from the inventor's two forms of closure unit disclosured in Ser. No. 07/290,563, by simplifying the construction of the BOOKLET BINDING SYSTEM while providing sufficient frictional retaining force to maintain the closure in position. The earlier disclosure introduces individual tongue elements to receive the loops and provide a solid non-slipping unit. The present invention embodies a soft resilient material which secures the assembly by using the yieldable retaining flanges to create a sufficient frictional resistance to prevent longitudinal movement of the tines and the loops within the grooves of the closure.

DESCRIPTION OF THE DRAWINGS

FIG. 1 is the plan view of the binding assembly with portions broken away;

FIG. 2 is a side elevation view thereof;

FIG. 3 is an end view thereof;

FIG. 4 is a view taken on line 4—4 on FIG. 3 of the binder unit showing the deformation of the retaining flange;

FIG. 5 is a perspective view of a slightly modified form of the present invention;

FIG. 6 is a transverse sectional view taken through the assembly shown in FIG. 5; and FIG. 7 is a perspective view of the closure unit.

DETAILED DESCRIPTION OF THE PREFERRED EMBODIMENT

A conventional loop binder 15 is best shown in FIG. 1 and includes two opposed spaced apart rows of loops defining an access space A between said rows. Narrow paper receiving tine elements 15*a* and are provided on one side while the connecting loops segments 15*b* are provided on the opposite side of the continuous wire loop unit 15. The connecting loop segments 15*b* connect the respectively opposed tine elements 15*a* in the conventional manner.

The closure unit 10 has a central body portion 10*c* which is made from relatively rigid plastic extrudable thermoplastic material such as Polyvinyl-chloride (PVC) or Acaylonitrile-butadiene-styrene (ABS) having an approximate duramater hardness of approximately 110. Resiliently yieldable retaining flanges 10*a* and 10*b* form the outer edge for the loop receiving grooves 11*a* and 11*b* and are also made from thermoplastic material which is extrudible and has a duramater hardness of 60 to 90. The lines 10*d* and 10*e* identify joint between the material of central body portion 10*c* and the material of retaining flanges 10*a* and 10*b*. Conventional plastic extruding machines are capable of extruding multiple materials through successive die heads arranged successively along the extrusion path. Such a machine is manufactured by Cincinnati Millicron of Lebanon, Ohio.

The resiliently yieldable retaining flanges 10*a* and 10*b* are constructed of a soft plastic material to allow for deformation as seen, for example, in FIGS. 4 and 5. The deformation increases the frictional lock between the closure unit 10 and the loop binder 15. The loop receiving grooves 11*a* and 11*b* are inclined at the approximate angle of the rows of tine or loop elements 15*a* and 15*b* of the loop binder 15, as shown in FIG. 3. The desired spacial relationship, necessary for retaining the closure in binding position, between the loop binder 15 and the closure unit 10 is such that the distance across space A is preferably slightly greater than the distance between the receiving grooves 11*a* and 11*b* to enhance the displacement of the respective resiliently yieldable retaining flanges 10*a* and 10*b*. The closure unit 10 is slid over the ends of the tines 15*a* and loops 15*b* to close the space disposed therebetween and to position the closure 10 in binding position. The resiliently yieldable retaining flanges 10*a* and 10*b* are laterally resiliently displaced by the paper receiving tines 15*a* and the connecting loops 15*b*, as best shown in FIGS. 4 and 5. The effect of the deformation of the resiliently yieldable retaining flange is to create an increased frictional resistance between the loop binder 15 and the closure unit 10 when the booklet binding system is in binding position. This increased frictional resistance prevents longitudinal movement when the system is inadvertently jarred and/or regular daily use tends to longitudinally displace the single integral closure unit 10 from the loop binder 15. However, the closure unit 10 may be removed when needed to add or replace sheets of paper. The flexible outer flanges are used to prevent unnecessary and unintended longitudinal movement between the closure unit 10 and the loop binders 15.

The resiliently yieldable retaining flange or flanges may be extruded beyond the plane defined by the inner edges of the grooves 11*a* and 11*b*. The longer resilient flanges are illustrated in FIG. 6. The extension provides increased frictional resistance to movement between the closure unit 10 and loop elements of the binder 15 while in binding position.

What is claimed is:

1. A booklet binding system for use with a loop binder of the type having a pair of opposed spaced apart rows of loop segments, wherein one of the rows of segments forms narrow binding tine elements adapted to be received through the holes of pre-punched sheets and the other row of segments forms connecting loop segments spaced from the binding tine elements to provide a continuous wire loop unit, a closure unit adapted to be removably mounted in binding position in the space between the two rows of opposed loop segments to capture the sheets mounted on the tine elements, said closure unit including a central body portion and a pair of flanges defining a pair of spaced apart loop receiving grooves for respectively receiving the ends of the connecting loop segments on one side and the ends of the binding tine elements on the other side, means for retaining the closure unit in binding position between the loop segments, wherein the material of the closure unit on one side of at least one of the loop receiving grooves has different flexibility from the material on the other side of said one groove and is resiliently yieldable to permit sufficient deformation in response to pressure from the engaged row of spaced apart loop segments to resist movement of the closure unit when in assembled binding position with the loop binder.

2. The structure set forth in claim 1 wherein the material on one side of both of said grooves is resiliently yieldable to permit such deformation.

3. The structure set forth in claim 1 wherein the closure unit constitutes an integrally formed unit.

4. The structure set forth in claim 3 wherein the integrally formed unit is an extruded unit.

5. The structure set forth in claim 4 wherein the closure unit is extruded from a plurality of different materials with the central body portion being formed from a harder material and at least one of the flanges being formed from a softer material to provide the resilient yieldability.

6. The structure set forth in claim 5 and both of said flanges being formed from said softer material.

7. The structure set forth in claim 6 wherein the body material has the duramater hardness of approximately 110 and the flanges having a duramater hardness of between 60 to 90.

8. The structure set forth in claim 6 wherein both of said plastic materials constitute a thermal plastic material.

9. The structure set forth in claim 1 wherein at least one of the resiliently yieldable retaining flanges are extruded beyond the central body portion of the closure unit.

10. The structure set forth in claim 9 wherein both of said flanges are extruded beyond the central body portions of the closure unit.

* * * * *